US007249909B2

(12) United States Patent
Bibber

(10) Patent No.: US 7,249,909 B2
(45) Date of Patent: Jul. 31, 2007

(54) VEHICLE RESTRAINING SYSTEM

(76) Inventor: Michael Van Bibber, 7604 Second St., NW. Albuquerque, NM (US) 87107

( * ) Notice: Subject to any disclaimer, the term of this patent is extended or adjusted under 35 U.S.C. 154(b) by 0 days.

(21) Appl. No.: 11/260,827

(22) Filed: Oct. 27, 2005

(65) Prior Publication Data

US 2006/0045618 A1 Mar. 2, 2006

Related U.S. Application Data

(63) Continuation-in-part of application No. 10/888,337, filed on Jul. 9, 2004, now Pat. No. 7,014,388.

(51) Int. Cl.

| | |
|---|---|
| ***E01F 13/00*** | (2006.01) |
| ***E01F 15/00*** | (2006.01) |
| *E01F 13/02* | (2006.01) |
| *E01F 13/04* | (2006.01) |

(52) U.S. Cl. ..... 404/6; 49/9

(58) Field of Classification Search ..... 404/6; 49/9

See application file for complete search history.

(56) References Cited

U.S. PATENT DOCUMENTS

| | | | | |
|---|---|---|---|---|
| 1,353,811 | A * | 9/1920 | Muncy | 114/240 E |
| 1,748,563 | A * | 2/1930 | Strauss | 49/9 |
| 1,798,137 | A * | 3/1931 | Beck | 244/138 R |
| 1,929,859 | A * | 10/1933 | Strauss | 246/29 R |
| 2,237,106 | A * | 4/1941 | Minert | 49/9 |
| 2,251,699 | A * | 8/1941 | Banschbach | 49/9 |
| 2,336,483 | A * | 12/1943 | Hoover | 49/9 |
| 2,455,018 | A * | 11/1948 | McKeown | 49/102 |
| 2,747,661 | A * | 5/1956 | Lucas | 160/10 |
| 4,947,764 | A * | 8/1990 | Rohr | 109/3 |
| 5,634,738 | A * | 6/1997 | Jackson et al. | 404/6 |
| 6,219,959 | B1 * | 4/2001 | Hsieh | 43/59 |

* cited by examiner

*Primary Examiner*—Raymond Addie
(74) *Attorney, Agent, or Firm*—Ray R. Regan

(57) ABSTRACT

The specification and drawing figures describe and show a vehicle restraining system that includes a truss assembly. A rotateable drum is repositionable on the truss assembly. A gravitationally deployable vehicle restraining device is removably attachable to the drum and to the truss assembly. At least one cable is disengageably connectable to the drum and to the truss assembly. A plurality of guide rods is installed on the truss assembly in opposing spaced-apart pairs, and a boom is provided that is repositionable on the plurality of guide rods. At least one motor is mountable on the boom for both repositioning the boom on the plurality of guide rods and for rotating the drum to enfold the gravitationally deployable vehicle restraining device on the drum.

25 Claims, 17 Drawing Sheets

VEHICLE RESTRAINING SYSTEM

CROSS-REFERENCE TO RELATED APPLICATION

This application is a continuation-in-part of U.S. application Ser. No. 10/888,337 filed in the U.S. Patent Office on Jul. 9, 2004, now U.S. Pat. No. 7,014,388 entitled Anti-Vehicle Security System, the specification of which is incorporated by reference into this document.

FIELD OF TECHNOLOGY

The apparatus and method disclosed in this document pertain generally to security. More particularly, the new and useful vehicle restraining system claimed in this document pertains to a device for restraining vehicular entry into a prohibited area. The vehicle restraining system is particularly, but not exclusively, useful for prohibiting vehicular entry without causing either the death of vehicle occupants, or destruction of the vehicle.

BACKGROUND

An international need has arisen to block vehicular entry into prohibited areas. At least one subcategory of achieving that goal includes blocking selected vehicular entry without injury either to the occupants or to the vehicle. Vehicular restraining apparatus thus far suggested by others include complicated devices whose sophistication may render such apparatus nonfunctional precisely when needed. For example, restraining devices have been proposed that require propulsion systems for raising structural components, components that may not propel when needed. Similarly, telescoping supports and arms may not telescope when operation is desired. Other vehicle inhibitors call for frangible materials in a variety of components that must be replaced after each use, a limitation in remote areas. Accordingly, need exists in the industry for the new, useful, simple to install, and simple to operate vehicle restraining system disclosed and claimed in this document.

SUMMARY

While the apparatus disclosed and claimed in U.S. application Ser. No. 10/888,337 filed in the U.S. Patent Office on Jul. 9, 2004, entitled Anti-Vehicle Security System, has proven useful in a variety of situations and installations, additional optimizations shown and claimed in this document provide a vehicle restraining system that results in more rapid deployment and reconfiguration of the vehicle restraining device for redeployment.

The vehicle restraining system disclosed and claimed in this document includes multiple embodiments of a truss assembly. In at least one embodiment, a container having a hinged door is fixed on the truss assembly. The system also includes two spaced-apart guides that extend from within the container to a portion of the truss assembly that is in ground contact. A gravitationally deployable restraining device, stored in and deployed from the container, includes sleeves, clips and keepers to deploy the restraining device to snare a vehicle.

In other embodiments of a vehicle restraining system that include additional optimizations shown and claimed in this document, a vehicle restraining system results in a variety of configurations for achieving more rapid deployment and reconfiguration of the vehicle restraining device for redeployment. For example, the vehicle restraining system includes a truss assembly that does not include stanchions. A rotateable drum is provided that is repositionable on the truss assembly. In addition, a gravitationally deployable vehicle restraining device is removably attachable to the drum and to the truss assembly. In one embodiment, the gravitationally deployable vehicle restraining device includes a cable that may be connected to and disengaged from both the drum and the truss assembly. Also included is a plurality of guide rods installed on the truss assembly in opposing spaced-apart pairs. A boom is included that may be repositioned along the opposing pairs of the plurality of guide rods. In the embodiments shown in FIGS. 6A-7E at least one motor is included. The motor is mountable on the boom to reposition the boom on the plurality of opposing spaced-apart guide rods, and to rotate the drum to enfold the gravitationally deployable vehicle restraining device on the drum.

The term "gravitationally deployable restraining device," as used in this document, includes at least non-frangible open-meshed fabrics, nets, barriers, meshed materials, and sheets of material. The term "gravitationally deployable restraining device" also includes at least one cable intertwined with the gravitationally deployable restraining device. In one embodiment of the vehicle restraining system, ends of the cable are connectable to the two opposing spaced-apart guides.

It will become apparent to one skilled in the art that the claimed subject matter as a whole, including the structure of the apparatus, and the cooperation of the elements of the apparatus, combine to result in a number of unexpected advantages and utilities. The structure and co-operation of structure of the vehicle restraining system claimed in this document will become apparent to those skilled in the art when read in conjunction with the following description, drawing figures, and appended claims.

The foregoing has outlined broadly the more important features of the invention to better understand the detailed description that follows, and to better understand the contributions to the art. The vehicle restraining system claimed in this document is not limited in application to the details of construction, and to the arrangements of the components, provided in the following description or drawing figures, but is capable of other embodiments, and of being practiced and carried out in various ways. The phraseology and terminology employed in this disclosure are for purpose of description, and therefore should not be regarded as limiting. As those skilled in the art will appreciate, the conception on which this disclosure is based readily may be used as a basis for designing other structures, methods, and systems. The claims, therefore, include equivalent constructions. Further, the abstract associated with this disclosure is intended neither to define the vehicle restraining system claimed in this document, which is measured by the claims, nor intended to limit the scope of the claims. The novel features of the vehicle restraining system claimed in this document are best understood from the accompanying drawing figures, considered in connection with the accompanying description of the drawing, in which similar reference characters refer to similar parts, and in which:

DETAILED DESCRIPTION

Figure 1:
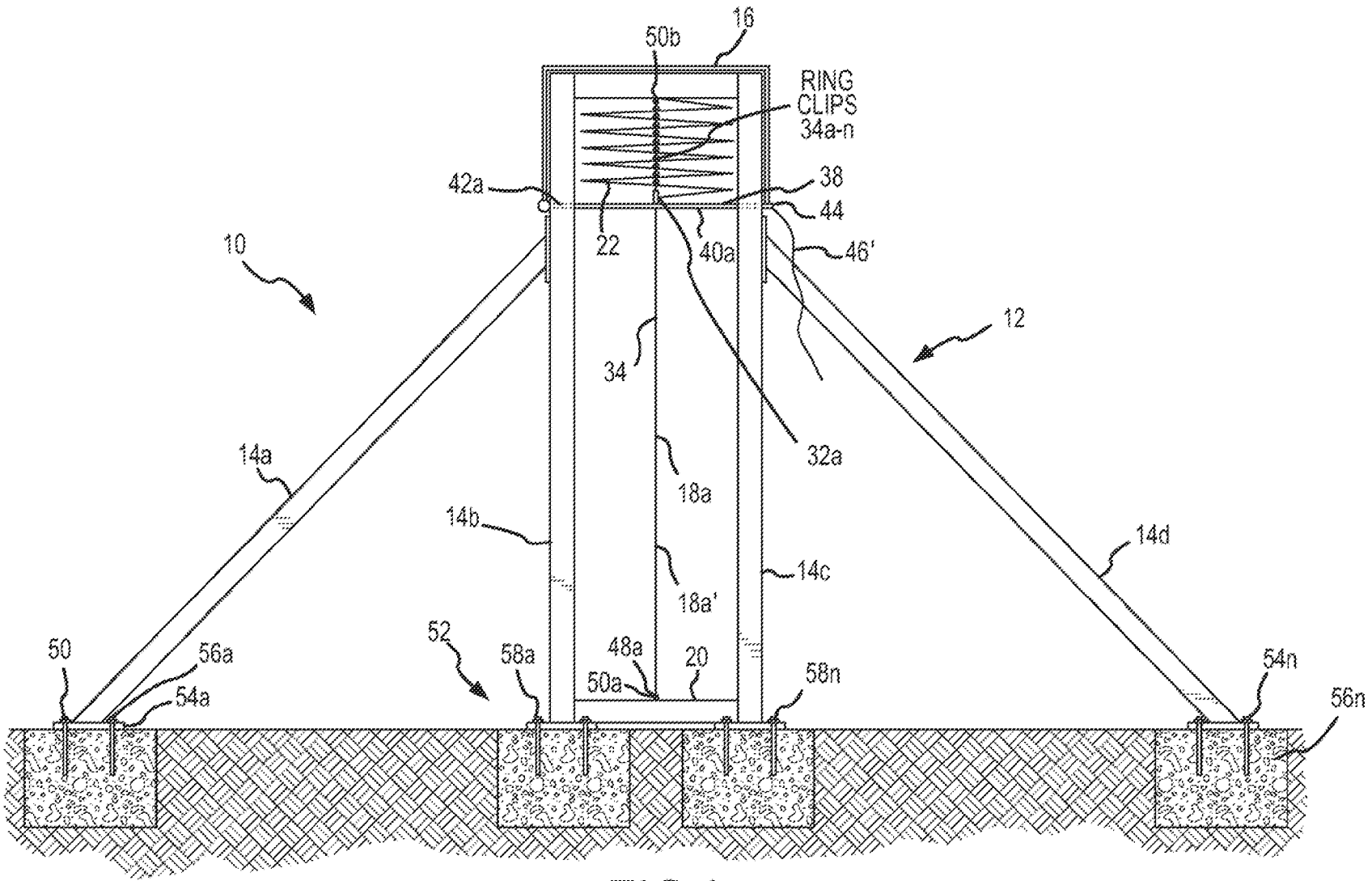
FIG. 1 of the drawing is a side view of the vehicle restraining system.
Figure 2:
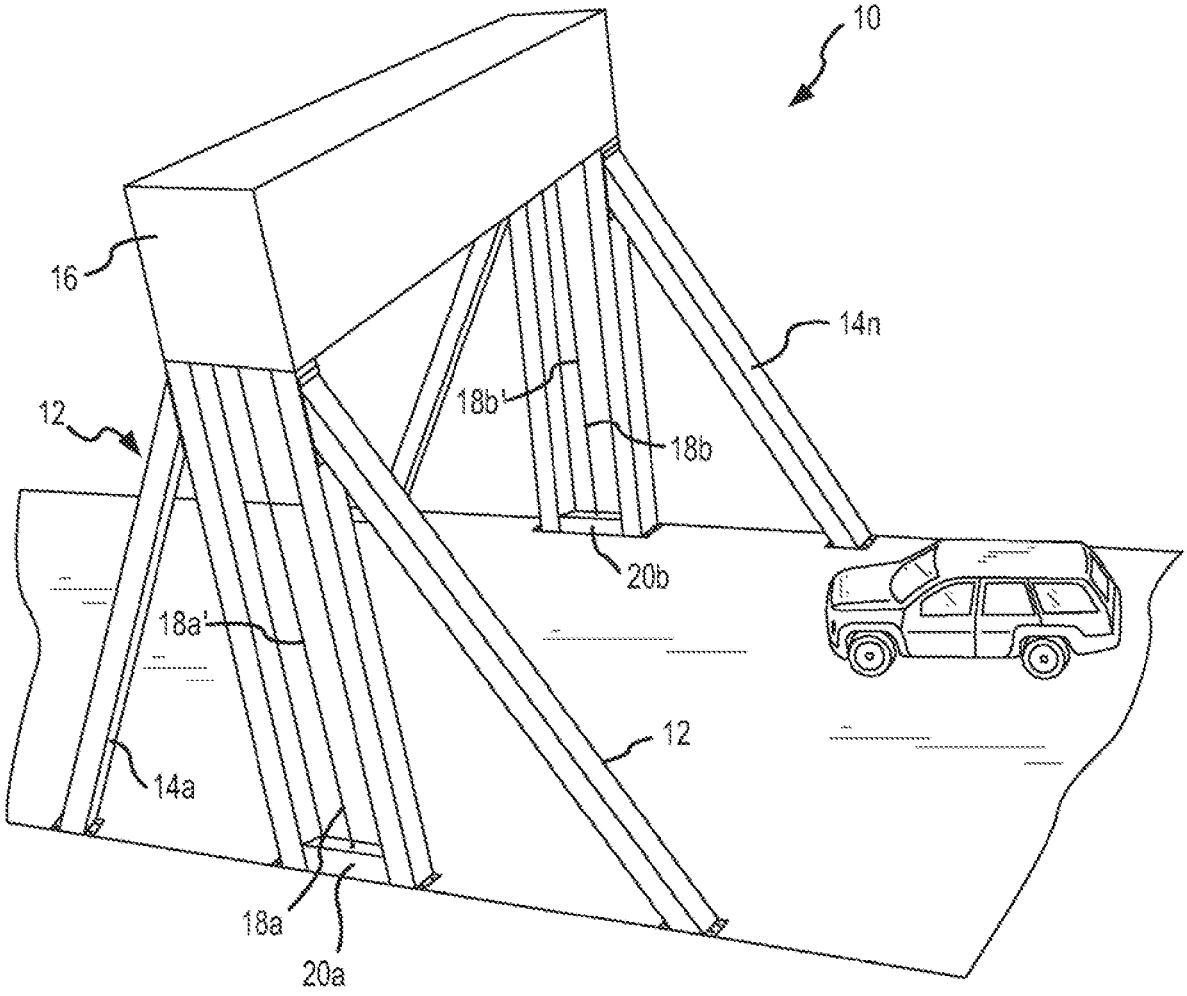
FIG. 2 is a perspective view of the vehicle restraining system before deployment with a vehicle approaching.
Figure 3:
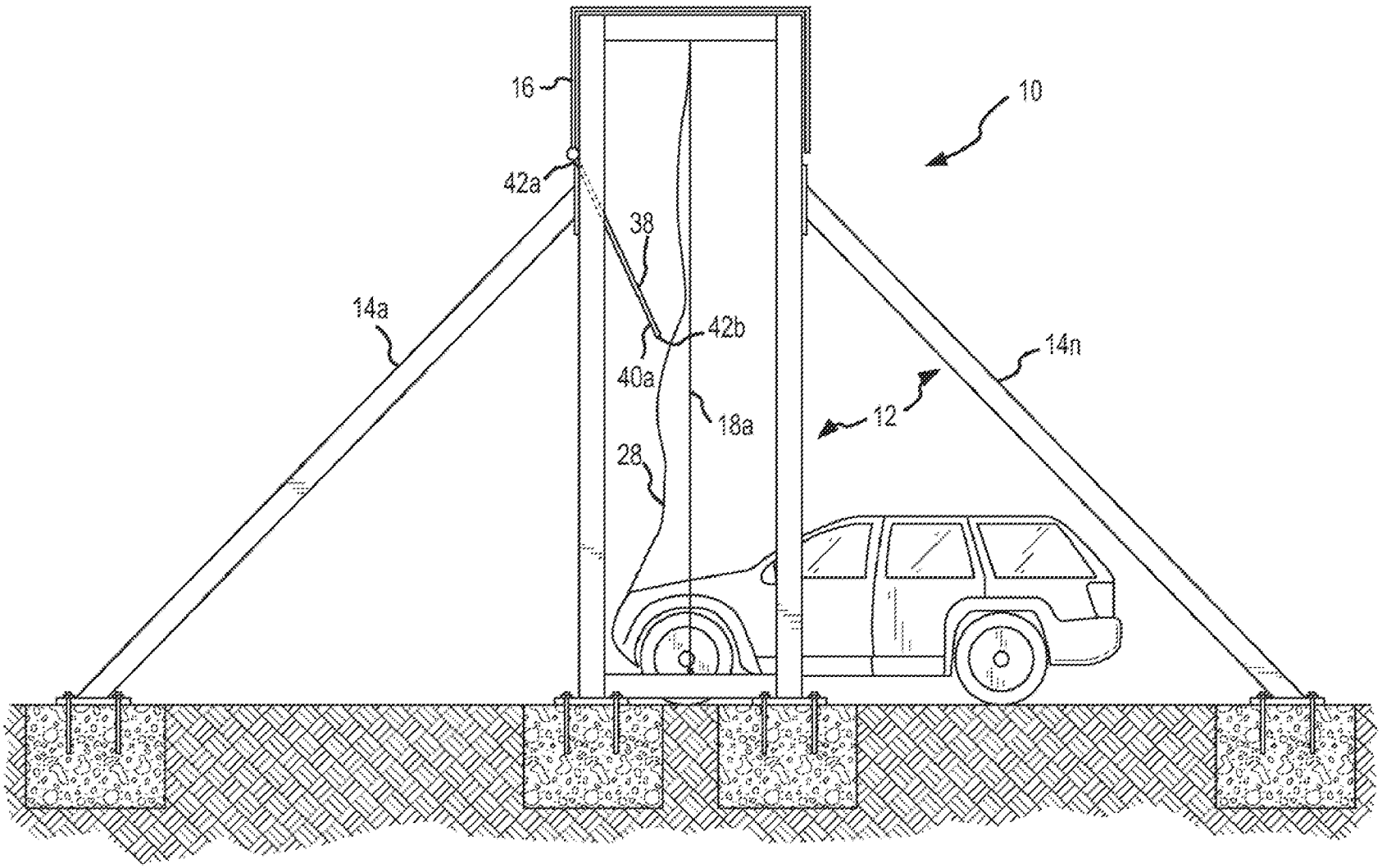
FIG. 3 is a side view of the partially deployed vehicle restraining system without a net.

As shown in FIGS. 1-5, a vehicle restraining system, generally designated 10, is provided that in its broadest context includes a truss assembly 12 formed with a plurality of monolithic stanchions 14; a container 16 fixed to truss assembly 12; two spaced-apart guides 18*a,b* extending from container 16 to a truss assembly member 20; a gravitationally deployable restraining device 22 that is removably insertable into container 16, and that also is connectable to two spaced-apart guides 18*a,b*; and also includes means 24 for deploying gravitationally deployable restraining device 22. In the embodiments shown in FIGS. 1-5 the vehicle restraining system 10 includes no motor, no hydraulic apparatus, and no devices operable by alternating current.

The term "gravitationally deployable restraining device," as used in this document, includes non-frangible open-meshed fabrics, nets, barriers, meshed materials, and sheets of material, generally designated 26, and referred to in this document for ease of reference as a "net." The term "gravitationally deployable restraining device" also includes at least one cable 28 intertwined with gravitationally deployable restraining device 22. As shown by cross-reference between FIGS. 4B and 5, net 26' is non-frangible.

Figure 4A:
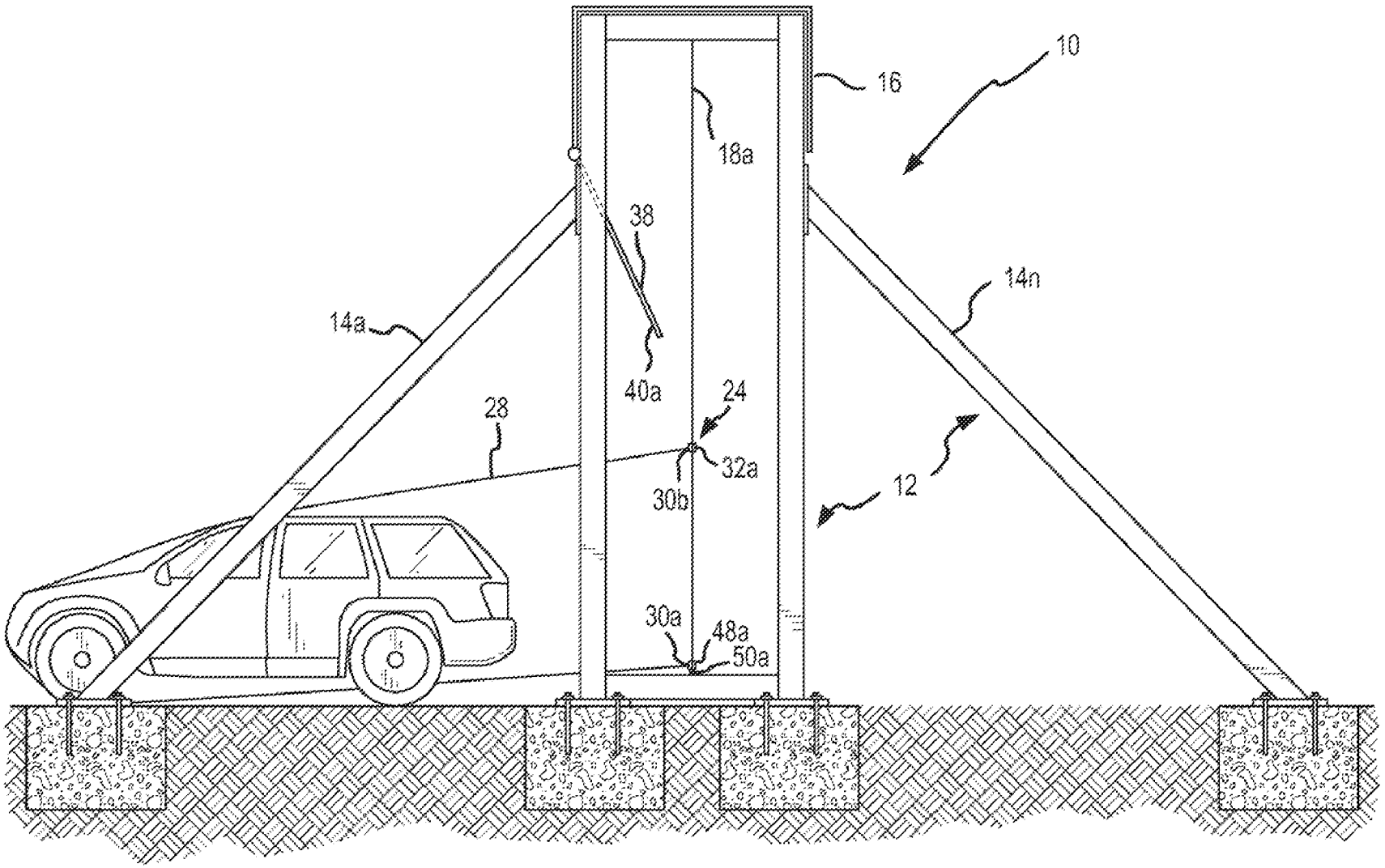
FIG. 4A is a side view showing a vehicle caught by the net of the vehicle restraining system.
Figure 4B:
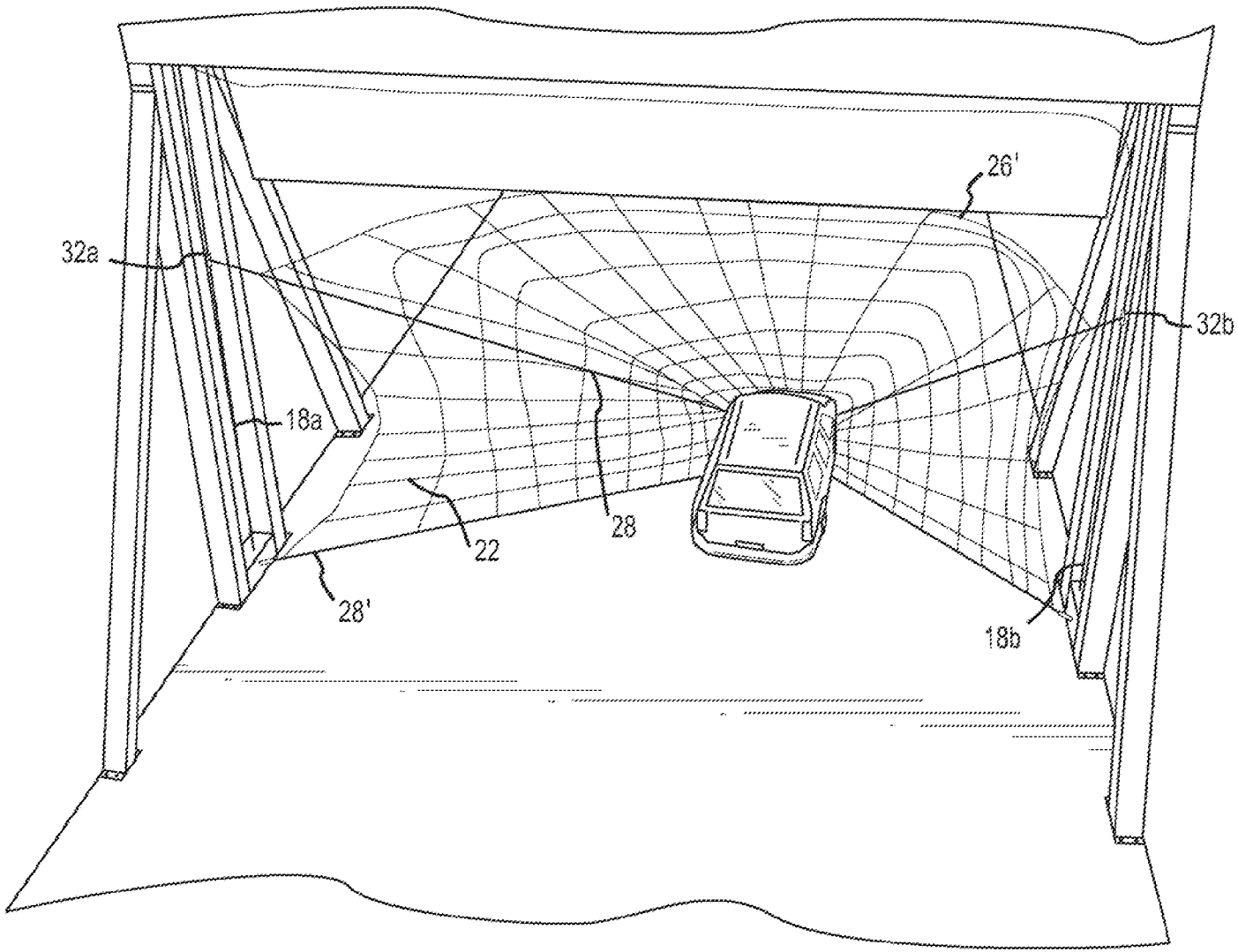
FIG. 4B is a perspective view showing a vehicle caught by the vehicle restraining system.
Figure 5:
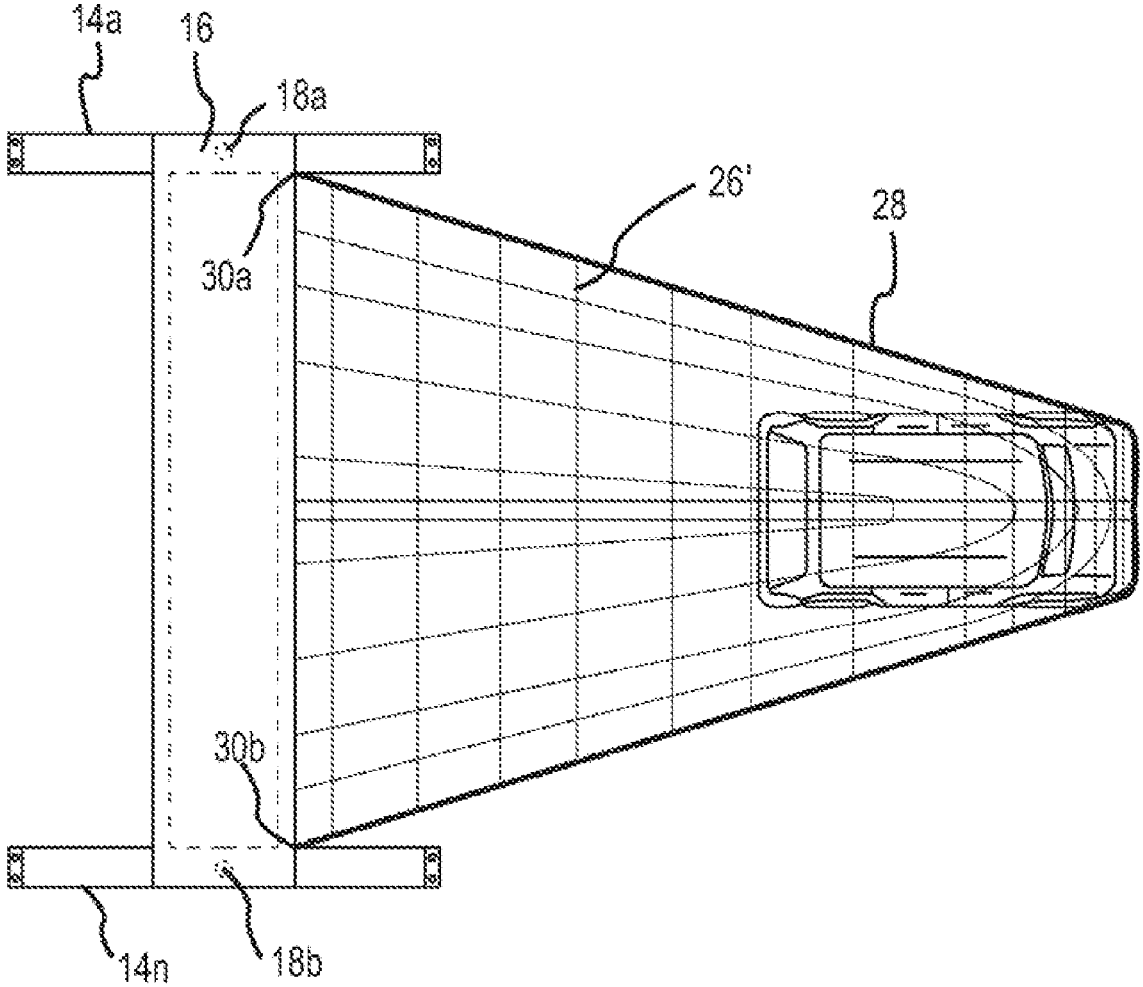
FIG. 5 is a top view showing a vehicle caught by the vehicle restraining system.

In the embodiments of vehicle restraining system 10, as shown by cross-reference between FIGS. 4A and 5, opposing ends 30*a,b* of cable 28 are connectable to two spaced-apart guides 18*a,b*. As perhaps best shown in the embodiment shown in FIGS. 1 and 3, spaced-apart guides 18*a,b* may be formed from cables 18*a*' and 18*b*'. In one embodiment of vehicle restraining system 10, as shown in FIGS. 1 and 4A, one or more sleeves 32*a,b* are provided. One or more sleeves 32*a,b* are connected to opposing ends 30*a,b* of cable 28 of gravitationally deployable restraining device 22. One or more sleeves 32*a,b* also are slideably mountable on two spaced-apart guides 18*a,b*. One or more sleeves 32*a,b* are weighted sufficiently to employ the force of gravity to remove the deployable restraining device 22 from the container 16 on opening of container 16.

As shown in FIG. 1, means 24 for deploying gravitationally deployable restraining device 22 also includes a plurality of ring clips 34*a-n*. Ring clips 34*a-n* are attachably detachable to gravitationally deployable restraining device 22. Ring clips 34*a-n* also are slideably engageable with the outer surface 34 of two spaced-apart guides 18*a,b*. As a person skilled in the art will appreciate, ring clips 34*a-n* may be selected from clips like parachute release clips used for connecting a military parachute to a static line. Ring clips 34*a-n* may be salvageable or of the break-away type.

In another embodiment of vehicle restraining system 10, as perhaps best shown in FIG. 1, means 24 for deploying gravitationally deployable restraining device 22 also includes a door 38. Door 38 is rotatably mounted on container 16. Door 38 includes opposing sides 40*a,b* (40*b* not shown) and opposing edges 42*a,b*. In one embodiment of vehicle restraining system 10, opposing edge 42*a* is rotatably mounted on container 16 using a hinge assembly comparable to a piano hinge (not shown in detail). In another embodiment, door 38 is dimensioned along the longitudinal axis parallel to opposing edges 42*a,b* to be less than the dimension of container 16 to allow space for spaced-apart guides 18*a,b* to extend through a space (not shown) between opposing sides 40*a,b* and container 16. At least one latch 44 is included. Latch 44 may be attached to any number of means 46 for releasing latch 44. In one embodiment, as shown in FIG. 1, means 46 for releasing latch 44 is a lanyard 44' extending from latch 44 to an operator of vehicle restraining system 10. In another embodiment of vehicle restraining system 10, means 46 for releasing latch 44 is a sensor-controlled remote control unit operated by battery (not shown).

As also shown by cross-reference between FIGS. 1 and 4A, vehicle restraining system 10 includes in one embodiment a keeper 48. Keepers 48*a,b* are fixed to lower extremities 50*a,b* of two spaced-apart guides 18*a,b*. As shown, the term "lower" means in a direction opposite door 38 of container 16. Keepers 48*a,b* also are fixed to opposing ends 30*a,b* of cable 28.

As perhaps best shown in FIG. 1, vehicle restraining system 10 includes in one embodiment means 52 for securing the vehicle restraining system at a selected site. As shown, in one embodiment means 52 for securing the vehicle restraining system at a selected site includes footer plates 54*a-n*. Footer plates 54*a-n* may be affixed to footings 56*a-n* as shown in FIG. 1. As will be evident to one skilled in the art, footer plates 54*a-n* may be affixed to footings 56*a-n* using any of a number of connectors well known in the art, including nuts and bolts 58*a-n*.

In operation of the embodiments shown by cross-reference between FIGS. 1-5, vehicle restraining system, generally designated 10, is secured at the entrance to a site into which vehicular traffic is prohibited. Footings 56*a-n* are formed from a material such a concrete, cured, and any of a number of connectors 58*a-n* are used to secure footer plates 54*a-n* to footings 56*a-n*, thus installing monolithic stanchions 14*a-n* of truss assembly 12 at a desired location. Container 16, with its rotatable door 38, has been mounted on truss assembly 12 as shown perhaps best in FIG. 1.

Restraining device 22 is attached to clips 34*a-n* that in turn are slidably mounted on spaced-apart guides 18*a,b*, as perhaps best shown in FIG. 4A. As indicated, restraining device 22 includes cable 28, opposing ends 30*a,b* of which are attached respectively to sleeves 32*a-b* and to keepers 48*a,b*. Much as one would pack a parachute, restraining device 22 may be packed into container 16. Door 38 is closed after restraining device 22 is packed into container 16, and latch 44 is secured.

Means 46, such as lanyard 46', is attached to latch 44. The other end of lanyard 46' is provided to an operator who is monitoring the secure site. When a suspicious vehicle seeks entry into the secure site, the operator may simply pull lanyard 46'. Door 38 swings open, and gravity pulls restraining device 22 from container 16. Gravity acts on sleeves 32*a,b* and on cable 28. In addition, opposing ends 30*a,b* of cable 28 are anchored to keepers 48*a,b* so that, in combination, cable 28 in restraining device 22 wraps around the motor vehicle A to preclude entry. Because none of the components need be frangible, restraining device 22 can be repacked and refolded into container 16 for reuse.

In alternative embodiments of a vehicle restraining system that includes additional optimizations shown and claimed in this document, and shown by cross-reference between FIGS. 6A-7E, a vehicle restraining system 100 results in a variety of embodiments and configurations for achieving more rapid deployment and reconfiguration of the gravitationally deployable vehicle restraining device 102 for redeployment. For example, the vehicle restraining system 100 includes a truss assembly 104 that does not include stanchions 14*a-n*. A rotateable drum 106 is provided that is repositionable on the truss assembly 104. In addition, the gravitationally deployable vehicle restraining device 102 is removably attachable to the drum 106 and to the truss assembly 104. The gravitationally deployable vehicle restraining device 102 includes a cable 108 that may be connected to and disengaged from both the drum 106 and the truss assembly 104. Also included is a plurality of guide rods 110 installed on the truss assembly in opposing spaced-apart pairs 110*a,b* and 110*c,d*. A boom 112 is included that may be repositioned along the opposing pairs 110*a,b* and 110 *c,d* of the plurality of guide rods 110*a-d*. In the embodiments shown in FIGS. 6A-7E at least one motor 114 is included. The motor 114 is mountable on the boom 112 to both reposition the boom 112 on the plurality of guide rods 110*a-d*, and to rotate the drum 106 to enfold the gravitationally deployable vehicle restraining device 102 on the drum 106.

Figure 6A:
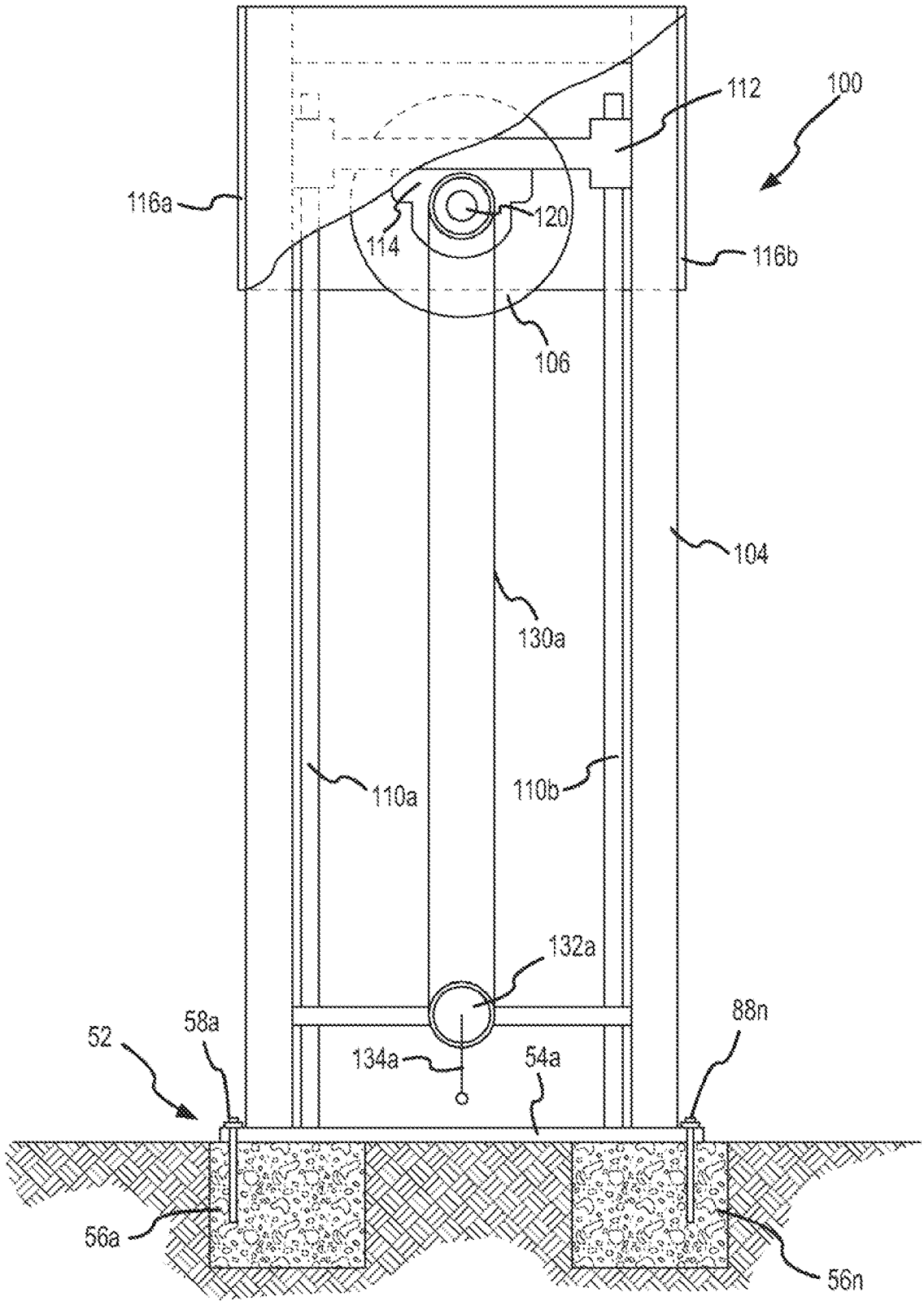
FIG. 6A is a side view showing the vehicle restraining system that includes a motor as well as a hand-crank.
Figure 6B:
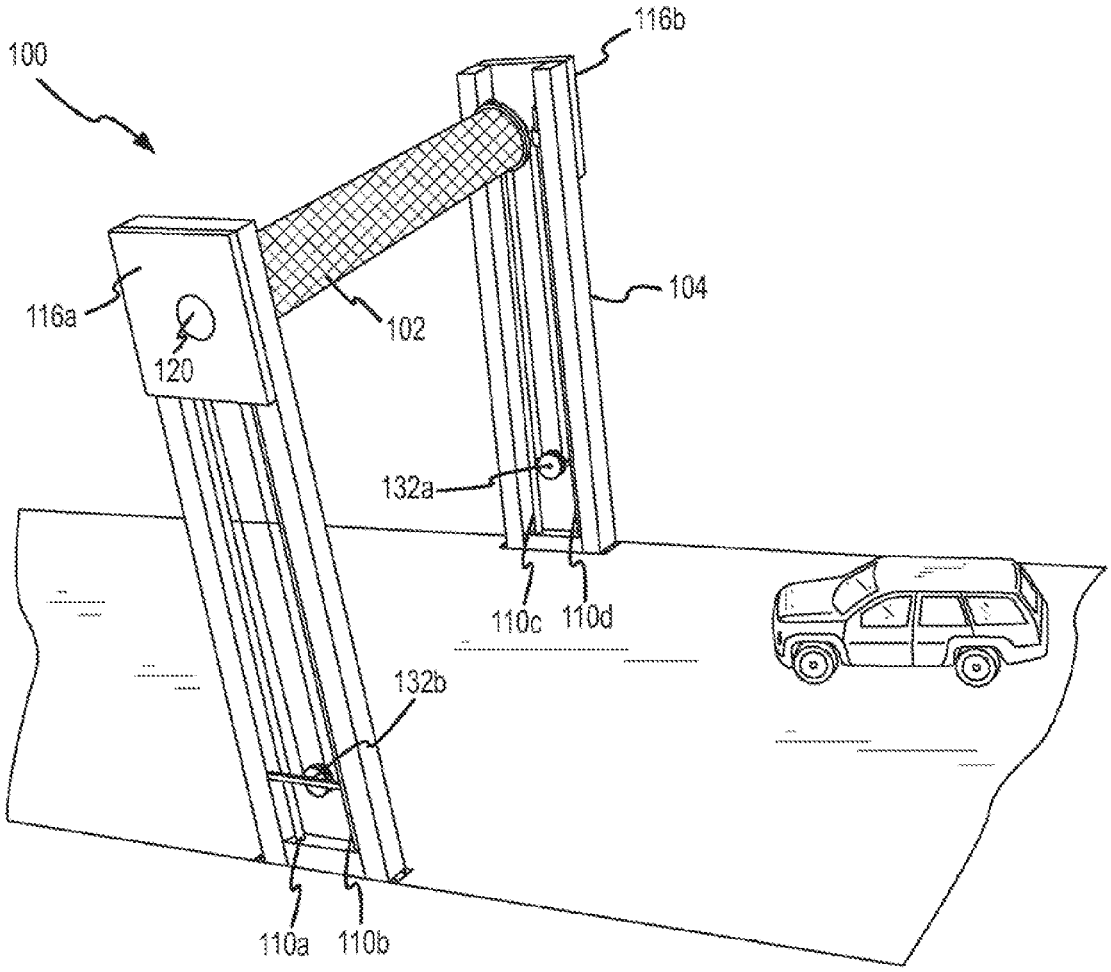
FIG. 6B shows the installed vehicle restraining system with a car approaching the system.
Figure 6C:
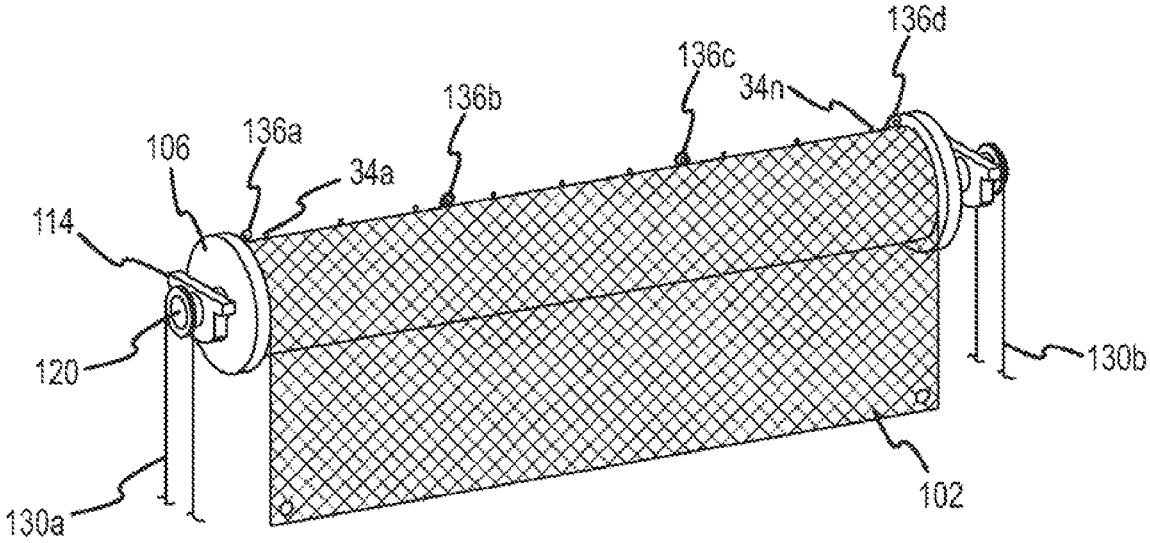
FIG. 6C shows the vehicle restraining device enfolded on the drum.
Figure 6D:
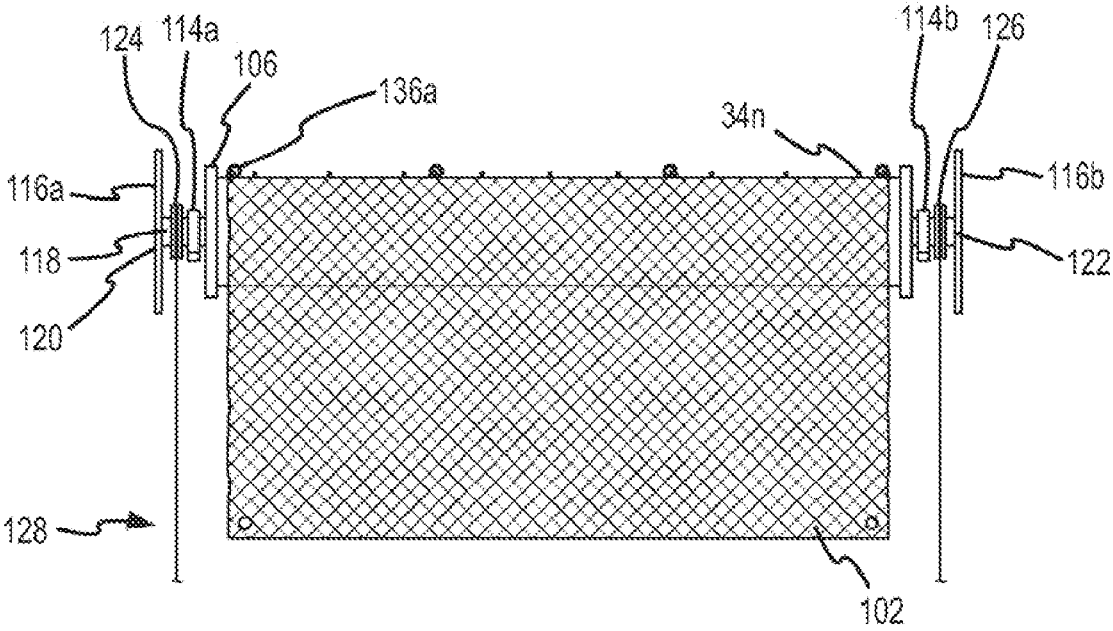
FIG. 6D shows a front view of the vehicle restraining device enfolded on the drum.
Figure 6E:
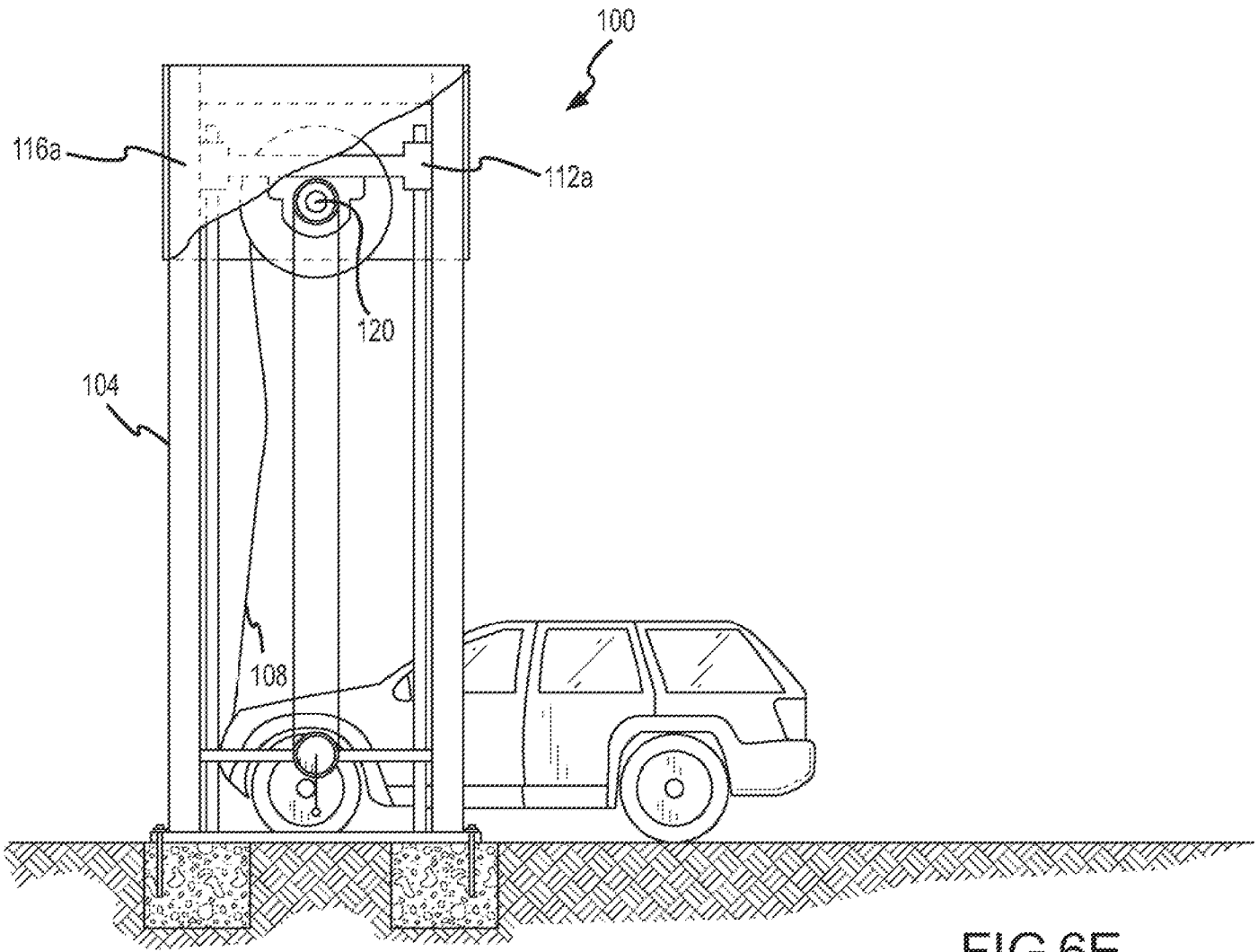
FIG. 6E shows a vehicle entering the vehicle restraining system.

More specifically, as shown by cross-reference between FIGS. 6A and 6B, vehicle restraining system 100 includes in one embodiment end plates 116*a,b*. End plates 116*a,b* may be used both to support extensions of drum 106 and also to add to the strength and appearance of truss assembly 104. As shown perhaps best by cross-reference between FIGS. 6A-6D, drum 106 includes a shaft 118. Shaft 118 is formed with a first end 120 and a second end 122. As shown, first end 120 of shaft 118 and second end 122 of shaft 118 are rotatably mountable in end plates 116*a,b*. Shaft 118 also is engageable with a first sprocket 124 and a second sprocket 126 as perhaps best shown in FIG. 6D. As shown, first sprocket 124 and second sprocket 126 are connectable to means 128 for mechanically rotating first sprocket 124 and second sprocket 126. Means 128 for mechanically rotating first sprocket 124 and second sprocket 126 include, as shown, cords 130*a,b* mounted in a closed loop on first sprocket 124, second sprocket 126, and pulleys 132*a,b*. Pulleys 132*a,b* are operatively connectable cranks 134*a,b*. A mechanical advantage of means 128 for mechanically rotating first sprocket 124 and second sprocket 126 arises from the capability of a user of vehicle restraining system 100 to unfurl vehicle restraining device 102 on drum 106 and as a backup apparatus for unfurling vehicle restraining device 102 from drum 106 in event of power failure that precludes use and operation of motor 114.

As also shown perhaps best by cross-reference between FIGS. 6A-6F, the shaft 118 of drum 106 is engageable with motor 114 that is mountable on boom 112. As indicated, boom 112 also is engageable with the plurality of guide rods 110, more specifically, with opposing spaced-apart pairs 110*a,b* and 110*c,d* of guide rods 110*a-d*. Motor 114 may be selected from a wide variety of AC or DC motors generally available in the industry. For example, motor 114 may be a parallel shaft gearmotor operating with the use of alternative current or direct current, or at a right angle gearmotor also operating with the use of either alternating current or direct current. In general, gearmotors tend to operative as split phase, three phase and inverter duty three phase input motors having gear ratios that span 5:1 to 2,200:1, and with power ranges from 1/40 horsepower to ½ horsepower. As shown, motor 114 is operatively connectable to a source of power. In operation, motor 114 may provide two different functions. Motor 114 may be used to rotate drum 106 either clockwise or counter-clockwise on shaft 118 to furl and unfurl vehicle restraining device 102 on or from drum 106. In addition, motor 114, because it is mounted on boom 112, may be used to position and re-position boom 112 on guide rods 110*a-d*, thus increasing the speed with which a deployed vehicle restraining device 102 may be prepared for additional operations.

Figure 6F:
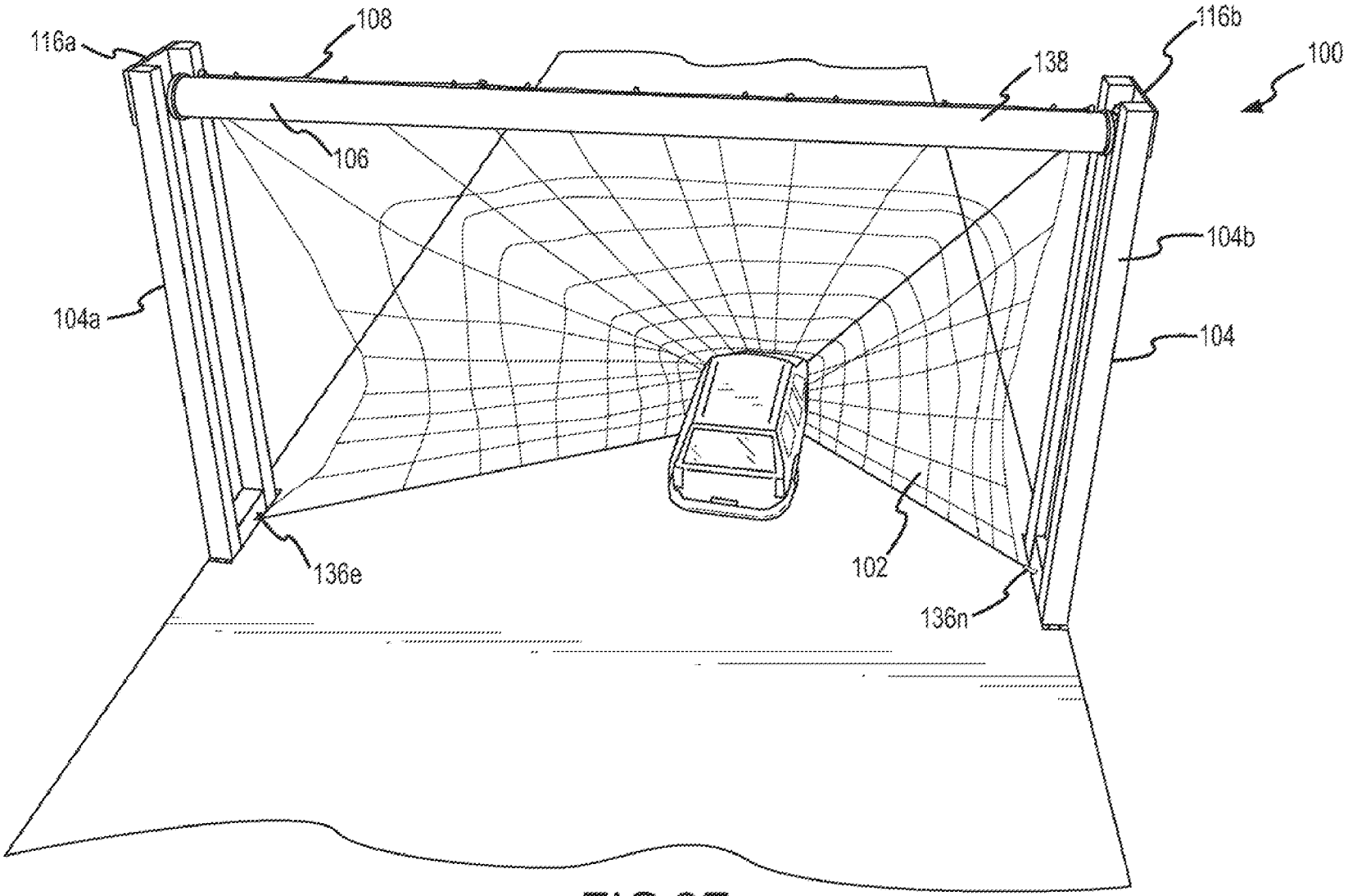
FIG. 6F shows the vehicle restrained by the vehicle restraining system.
Figure 6G:
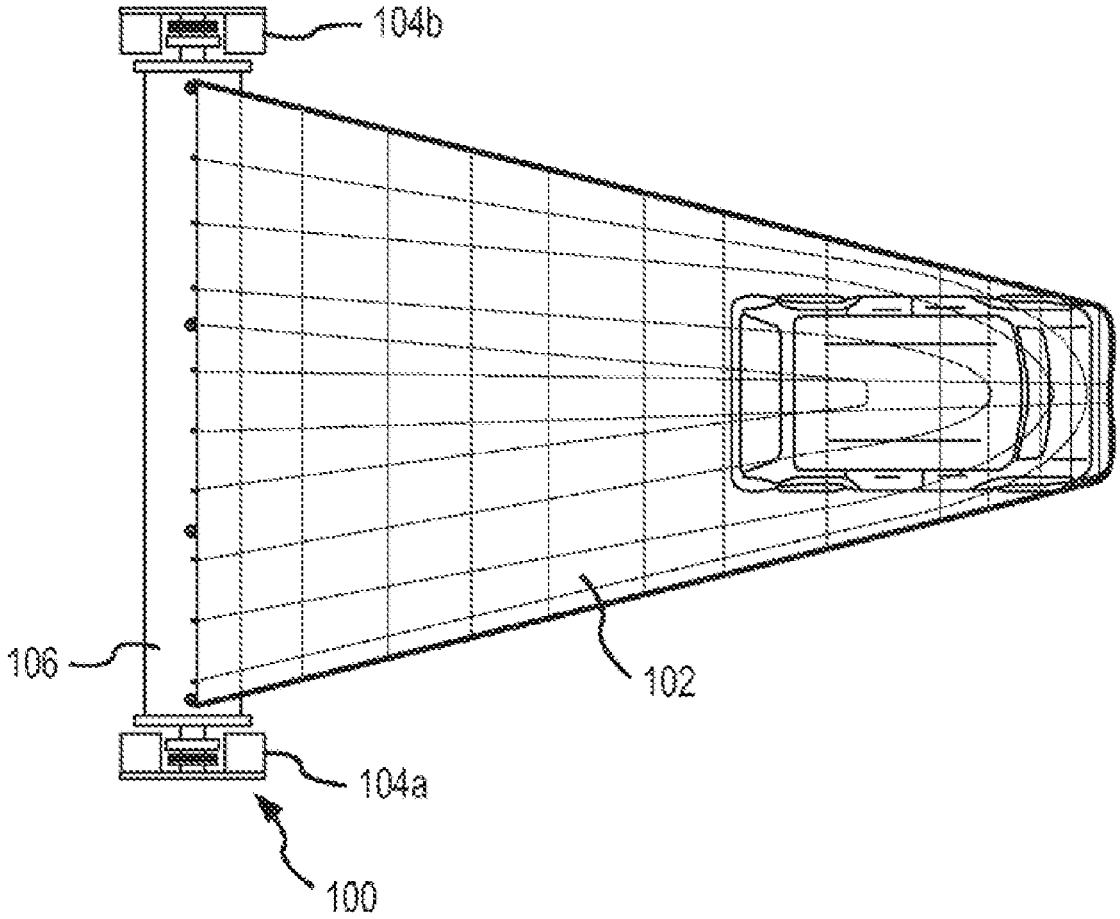
FIG. 6G shows a top view of the vehicle restrained by the vehicle restraining system.

As also shown by cross-reference between FIGS. 6A-6F, at least one cable 08 included in vehicle restraining device 102 is disengageably connectable to drum 106 and to truss assembly 104. One or more circular loops 136*a-n* are fixed to the surface 138 of drum 106. Cable 108 may be threaded through circular loops 136*a-n*. Alternatively, shackles well known in the industry (not shown) may be attached to cable 108 and to circular loops 136*a-n* for disengageably connecting cable 108 to circular loops 136*a-n*. One or more clip rings 34*a-n* may be included for break-away attachment of vehicle restraining device 102 to cable 108. In addition, one or more circular loops 136*a-n*, as shown in FIG. 6F, may he mounted on truss assembly 104 for securing cable 108 during deployment and operation of vehicle restraining device 102 from drum 106.

Figure 7A:
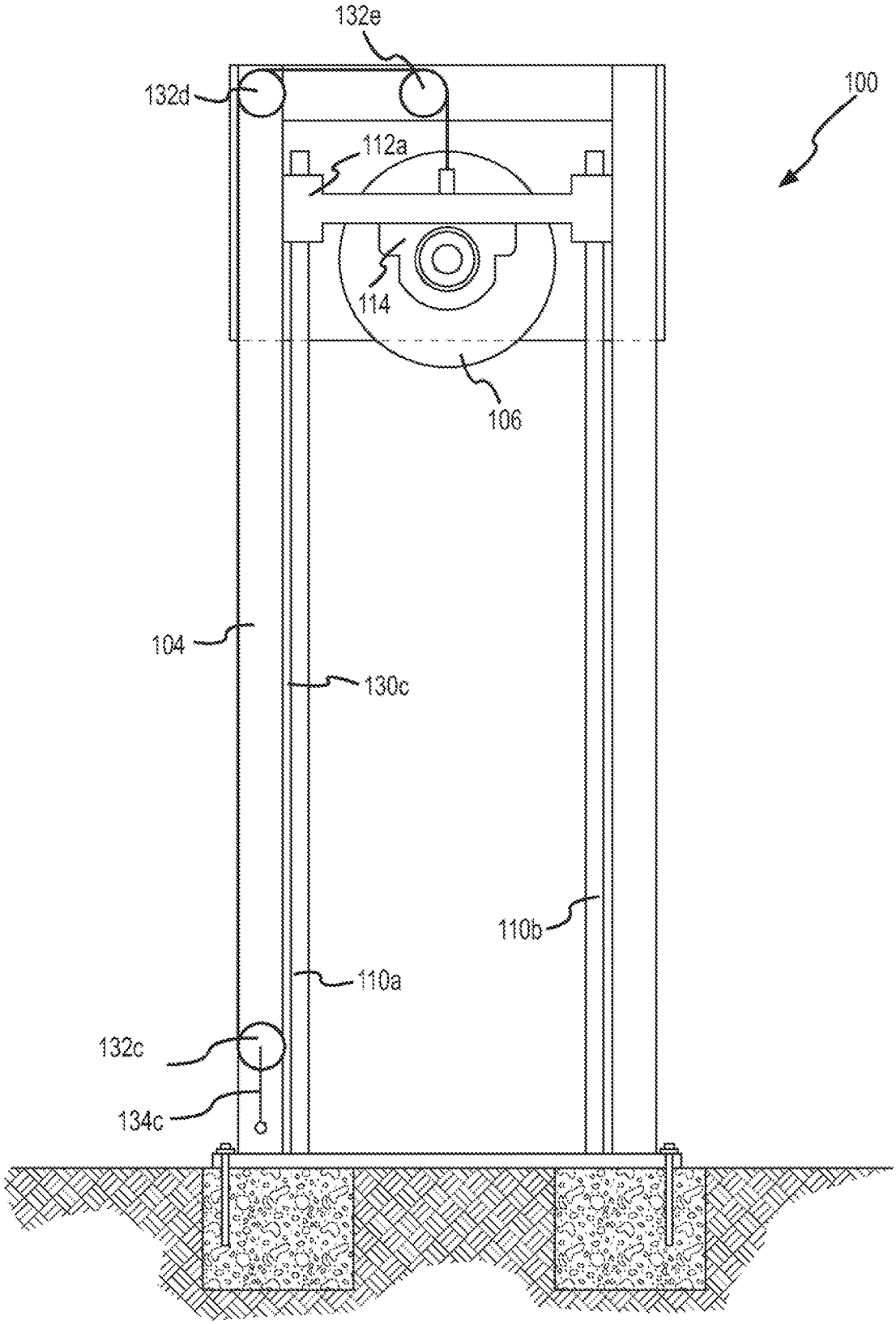
FIG. 7A shows one embodiment of the vehicle restraining system and the location of a hand-crank.
Figure 7B:
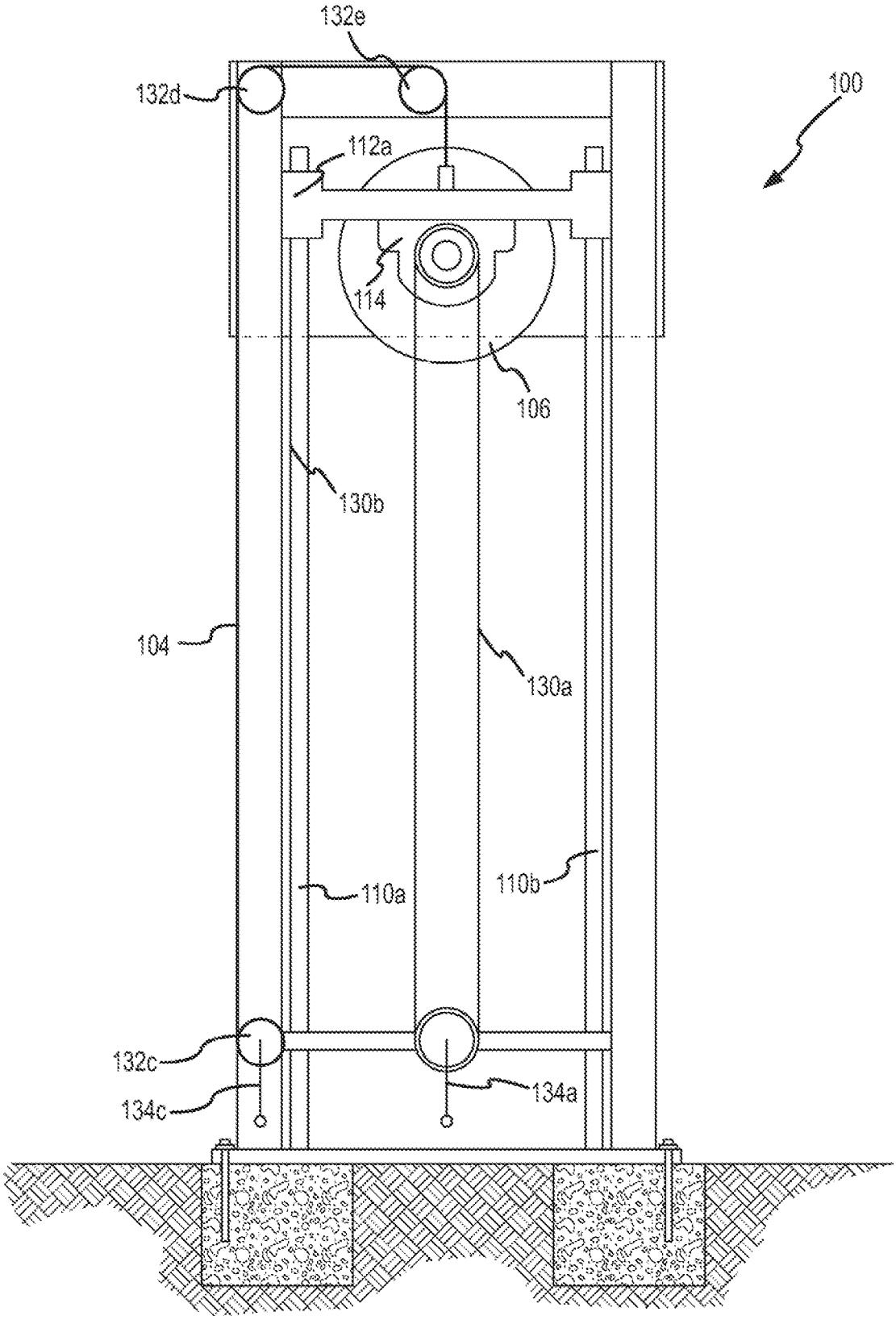
FIG. 7B shows an alternative embodiment of the vehicle restraining system.
Figure 7C:
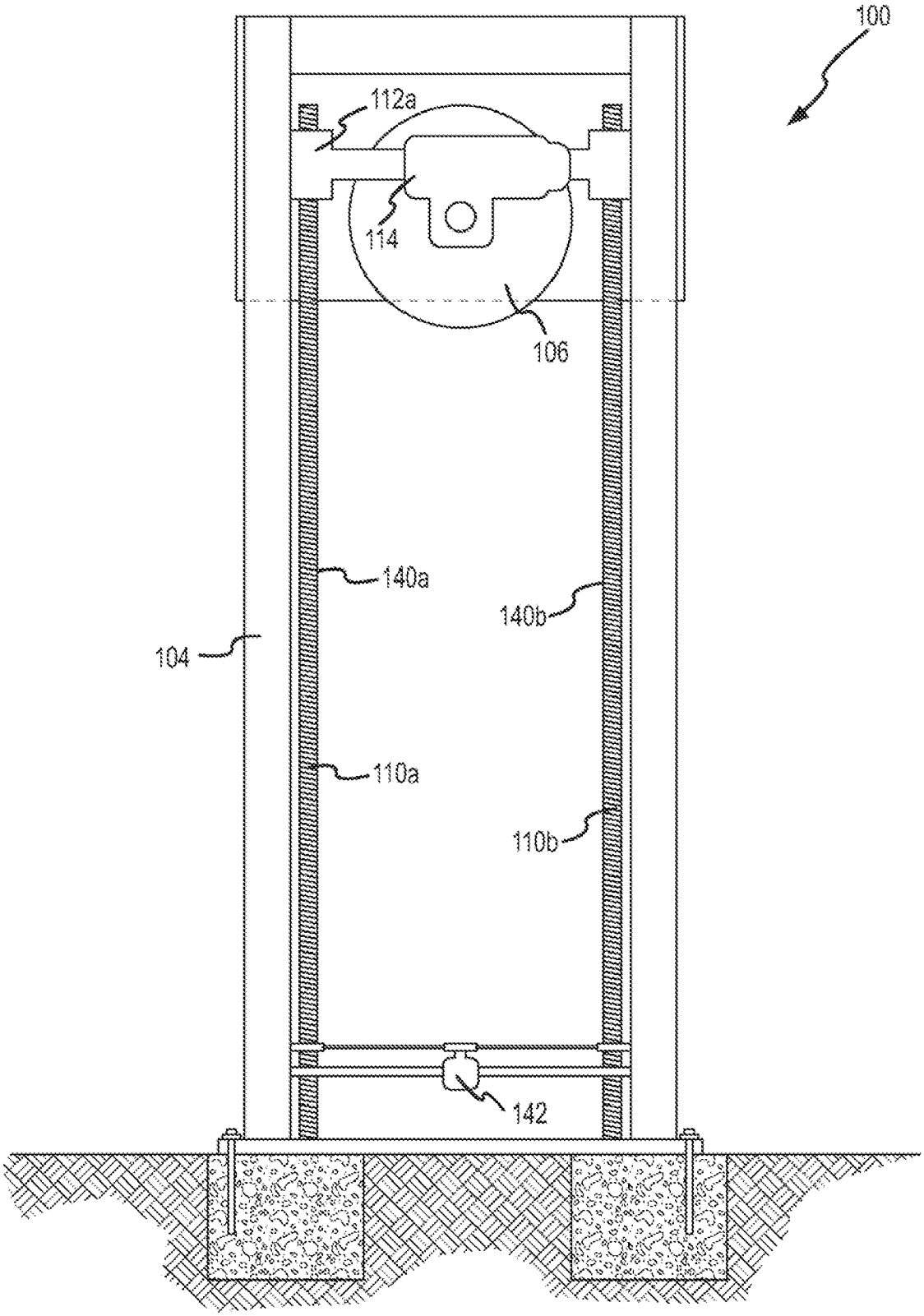
FIG. 7C shows yet another alternative embodiment of the vehicle restraining system.

As shown by cross-reference between FIGS. 7A-7E, a number of different embodiments of the components of vehicle restraining system 100 are possible. For example, as shown in FIG. 7A, a crank 134*c* may be operatively connected to a pulley 132*c* which is connected by cord 130*c* to pulleys 132*d* and 132*e* to mechanically lower and raise, and to generally reposition, drum 106 on guide rods 110*a-d* on truss assembly 104. In yet another embodiment of vehicle restraining system 100, FIG. 7B shows a combination of the components shown in FIGS. 6A and 7A, namely crank 134*a* operatively connectable to pulley 132*a* and to first sprocket 124 using cord 130*a*, as well as to crank 134*c* which is operatively connected to pulley 132*c* using cord 130*c* and to pulleys 132*d* and 132*e*, a combination of components that allows both rotation of drum 106 around shaft 118, and for repositioning drum 106 on guide rods 110*a-b*. In yet another embodiment, as shown in FIG. 7C, opposing spaced-apart guide rods 110*a-d* are provided with a screw surface 140.

Figure 7D:
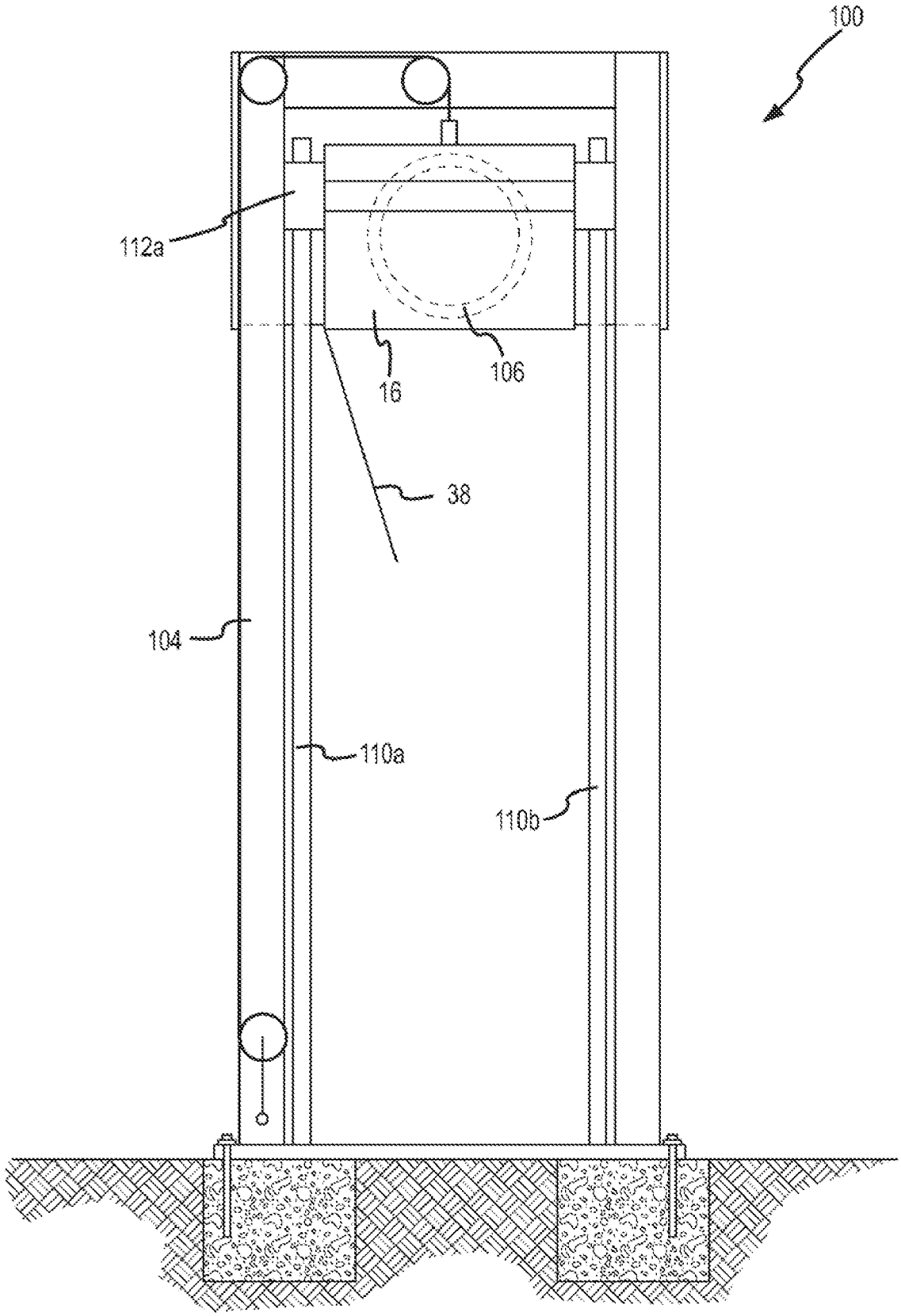
FIG. 7D shows another alternative embodiment of the vehicle restraining system using a container to hold the drum.
Figure 7E:
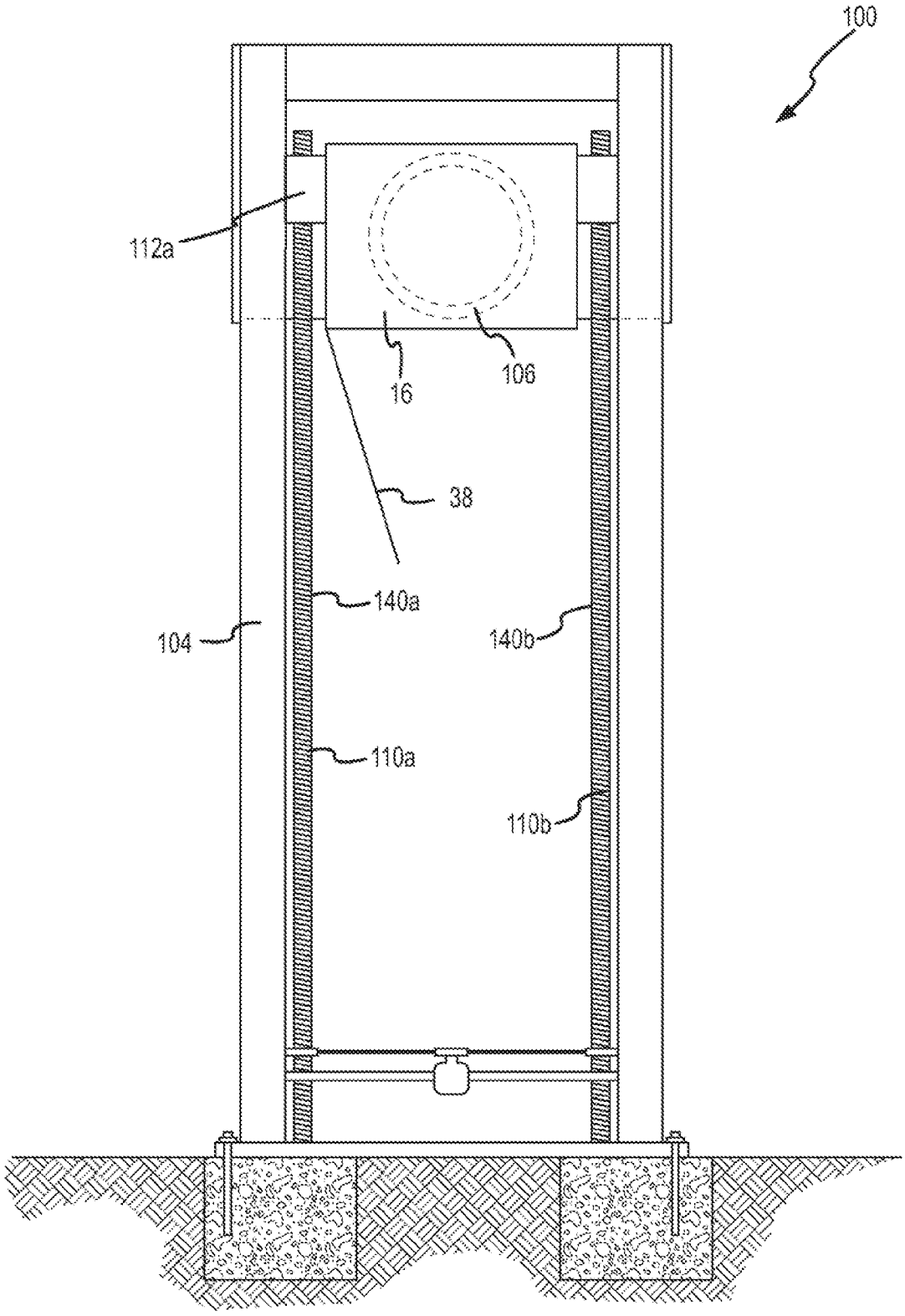
FIG. 7E shows another alternative embodiment of the vehicle restraining system.

Screw surface 140 of guide rods 110*a-d* is mateably engageable with boom 112. Motor 114, or, in the alternative, a second motor 142, may be used to reposition boom 112 as well as drum 106 along guide rods 110*a-d*. As shown in FIG. 7D, in addition to the components shown by cross-reference between FIGS. 7A-7C, a container 16 may be provided to house drum 106 and vehicle restraining device 102 when vehicle restraining device is not deployed. As shown, door 38 of container 16 may be provided with latch 44 to open and close door 38 for furling and unfurling vehicle restraining device 102 from drum 106.

The vehicle restraining system claimed in this document shows at least one embodiment in drawing FIGS. 1-7E, but is not intended to be exclusive, but merely illustrative of the disclosed but non-exclusive embodiments. Claim elements and steps in this document have been numbered and/or lettered solely as an aid in readability and understanding. Claim elements and steps have been numbered solely as an aid in readability and understanding. The numbering is not intended to, and should not be considered as intending to, indicate the ordering of elements and steps in the claims. Means-plus-function clauses in the claims are intended to cover the structures described as performing the recited function that include not only structural equivalents, but also equivalent structures. Thus, although a nail and screw may not be structural equivalents, in the environment of the subject matter of this document a nail and a screw may be equivalent structures.

What is claimed is:

1. An apparatus for stopping vehicle passage, comprising:

a restraining device;

a plurality of monolithically formed spaced-apart cable guides, wherein the restraining device is connectable to the plurality of monolithically formed spaced-apart cable guides by a plurality of break-away clips; and means for mechanical holding and gravitationally deploying the restraining device.

2. An apparatus for stopping vehicle passage as recited in claim 1, wherein the apparatus includes no motor.

3. An apparatus for stopping vehicle passage as recited claim 1, wherein the apparatus includes no hydraulic equipment.

4. An apparatus for stopping vehicle passage as recited in claim 1, wherein the apparatus includes no devices energized by alternating current.

5. An apparatus for stopping vehicle passage as recited in claim 1, wherein the restraining device includes non-frangible net.

6. An apparatus for stopping vehicle passage as recited in claim 1, wherein the restraining device is selected from the group of restraining devices consisting of open-meshed fabrics, barriers, meshed material, and sheets of material.

7. An apparatus for stopping vehicle passage as recited in claim 1, wherein the restraining device includes one or more cables.

8. An apparatus for stopping vehicle passage as recited in claim 1, wherein the holding and deploying means includes a plurality of sleeves couplable to the restraining device and slideably mountable on the plurality of monolithically formed spaced-apart cable guides.

9. An apparatus for stopping vehicle passage as recited in claim 1, wherein the holding and deploying means includes a keeper fixedly attached to the one or more cables.

10. An apparatus for stopping vehicle passage as recited in claim 1, wherein the holding and deploying means further comprises a container having a door.

11. An apparatus for stopping vehicle passage as recited in claim 1, wherein the holding and deploying means includes a latch for opening and closing the door.

12. An apparatus for stopping vehicle passage as recited in claim 1, further comprising means for securing the apparatus at a site.

13. A vehicle restraining system, comprising:

a truss assembly;

a rotateable drum repositionably mountable on the truss assembly between and at substantially a right angle to the truss assembly;

a gravitationally deployable vehicle restraining device removably attachable to the drum and to the truss assembly, wherein the gravitationally deployable vehicle restraining device further includes at least one cable disengageably connectable to the drum and to the truss assembly;

a plurality of guide rods installed on the truss assembly in opposing spaced-apart pairs;

a boom repositionable on the plurality of guide rods; and at least one motor mountable on the boom for both repositioning the boom on the plurality of guide rods and for rotating the drum to enfold the gravitationally deployable vehicle restraining device on the drum.

14. A vehicle restraining system as recited in claim 13, wherein the gravitationally deployable vehicle restraining device includes no hydraulic apparatus.

15. A vehicle restraining system as recited in claim 14, wherein the gravitationally deployable restraining device is selected from the group of gravitationally deployable restraining devices consisting of open-meshed fabrics, nets, barriers, meshed material, and sheets of material.

16. A vehicle restraining system as recited in claim 15 wherein the at least one cable is non-frangible.

17. A vehicle restraining system as recited in claim 16, further comprising a plurality of ring clips attachable to the gravitationally deployable restraining device and slideably engageable with the cable.

18. A vehicle restraining system as recited in claim 17, further comprising a crank rotatable by hand for repositioning the drum.

19. A vehicle restraining system as recited in claim 18, wherein the plurality of guide rods installed on the truss assembly in opposing spaced-apart pairs is formed with screw surfaces.

20. A vehicle restraining system as recited in claim 19, further comprising a container mounted on the truss assembly for housing the drum and enfolded gravitationally deployable vehicle restraining device.

21. A vehicle restraining system as recited in claim 20, wherein the container includes a mechanical construct for opening and closing a door.

22. A vehicle restraining system as recited in claim 21, further comprising means for securing the vehicle restraining system at a selected site.

23. A method for inhibiting vehicle movement, comprising:

constructing a truss assembly;

forming a rotateable drum that is repositionable on the truss assembly at substantially at right angle between opposing ends of the truss assembly;

selecting means for enfolding a vehicle restraining device on the drum; and providing means operatively connectable to the rotateable drum for rotating the drum and repositioning the drum on the plurality of guide rods arranged in opposing pairs.

24. A method for inhibiting vehicle movement as recited in claim 23, wherein the selecting means includes the substeps of:

selecting material to form a vehicle restraining device;

shaping the material into a net; and including a cable that is disengageably connectable to the drum and to the truss assembly.

25. A method for inhibiting vehicle movement as recited in claim 23, wherein the rotating and repositioning means include the substeps of:

including a plurality of guide rods arranged in opposing pairs on the truss assembly;

forming a boom repositionable on the plurality of guide rods;

providing at least one motor mountable on the boom for repositioning the boom on the plurality of guide rods and for rotating the drum to enfold the gravitationaily deployable vehicle restraining device on the drum; and mounting one or more pulleys and cranks on the truss assembly to reposition and rotate the drum.

* * * * *

UNITED STATES PATENT AND TRADEMARK OFFICE

CERTIFICATE OF CORRECTION

PATENT NO. : 7,249,909 B2
APPLICATION NO. : 11/260827
DATED : July 31, 2007
INVENTOR(S) : Michael Van Bibber It is certified that error appears in the above-identified patent and that said Letters Patent is hereby corrected as shown below:

TITLE PAGE, UNDER ITEM (12), DELETE "Bibber" AND INSERT --Van Bibber--.

Signed and Sealed this

Fourth Day of March, 2008

JON W. DUDAS
*Director of the United States Patent and Trademark Office*